US010830522B2

(12) United States Patent
Garcia et al.

(10) Patent No.: US 10,830,522 B2
(45) Date of Patent: Nov. 10, 2020

(54) CONDENSER BRACKET

(71) Applicant: WHIRLPOOL CORPORATION, Benton Harbor, MI (US)

(72) Inventors: Fernando Garcia, Nuevo Leon (MX); Rishikesh Vinayak Kulkarni, Hefei (CN); Antonio Sanchez, Benton Harbor, MI (US); Nathan Franklin Wolf, Bridgman, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 119 days.

(21) Appl. No.: 16/296,999

(22) Filed: Mar. 8, 2019

(65) Prior Publication Data

US 2020/0284494 A1 Sep. 10, 2020

(51) Int. Cl.

| | |
|---|---|
| ***F25D 19/00*** | (2006.01) |
| ***F25D 23/00*** | (2006.01) |
| ***F25B 39/04*** | (2006.01) |

(52) U.S. Cl.

CPC ..... *F25D 19/003* (2013.01); *F25B 39/04* (2013.01); *F25D 23/006* (2013.01)

(58) Field of Classification Search

CPC ..... F25D 19/003; F25D 23/006; F25B 39/04

See application file for complete search history.

(56) References Cited

U.S. PATENT DOCUMENTS

| | | | | |
|---|---|---|---|---|
| 3,736,768 | A | 6/1973 | Harbour et al. | |
| 3,990,262 | A * | 11/1976 | Griffin | F25D 23/006 62/295 |
| 5,107,688 | A | 4/1992 | Johnson | |
| 6,519,970 | B1 | 2/2003 | Rafalovich et al. | |
| 8,161,762 | B2 | 4/2012 | Sugimoto et al. | |
| 2016/0069595 | A1 | 3/2016 | Kim et al. | |
| 2017/0363335 | A1 | 12/2017 | Arbogast et al. | |

* cited by examiner

*Primary Examiner* — Cassey D Bauer
(74) *Attorney, Agent, or Firm* — Price Heneveld LLP

(57) ABSTRACT

A condenser assembly for a refrigerating appliance is provided herein. The condenser assembly includes an anchor coupled with a first panel of a housing. A bracket is coupled to the anchor and extends from the first panel of the housing. The bracket includes a body having first and second ends. A flange extends from the body and is coupled to the anchor. A condenser has first and second ends. One of the first and second ends is operably coupled to the bracket such that the condenser is positioned at an obtuse angle relative to the flange of the bracket.

20 Claims, 6 Drawing Sheets

CONDENSER BRACKET

FIELD

The present device generally relates to a bracket, and more specifically to a bracket for a condenser within a refrigerating appliance.

BACKGROUND

When air is blown toward a condenser in a cooling system of a refrigerating appliance, the air may seep through gaps between the condenser and the walls of the mechanical cavity the cooling system is positioned within. The air seeping through the gaps prevents the air from flowing over the condenser.

BRIEF SUMMARY OF THE DISCLOSURE

In at least one aspect of the present disclosure, a condenser assembly is provided. The condenser assembly includes a housing positioned within a refrigerating appliance. The housing includes a first panel spaced apart from a second panel. A first anchor is operably coupled with the first panel. A second anchor is operably coupled with the second panel. The first anchor is offset from the second anchor. A bracket is coupled with the second anchor. The bracket defines a channel extending from a first open end and a second open end. A flange extends from the bracket. A condenser has first and second ends and extends diagonally between the first anchor and the bracket. One of the first and second ends is received by the channel of the bracket.

In at least another aspect of the present disclosure, a condenser assembly for a refrigerating appliance is provided. The condenser assembly includes an anchor coupled with a first panel of a housing. A bracket is coupled to the anchor and extends from the first panel of the housing. The bracket includes a body having first and second ends. A flange extends from the body and is coupled to the anchor. A condenser has first and second ends. One of the first and second ends is operably coupled to the bracket such that the condenser is positioned at an obtuse angle relative to the flange of the bracket.

In yet another aspect of the present disclosure, a method for positioning a condenser within a refrigerating appliance is provided herein. The method includes a step of forming a housing having first and second sidewalls joined by a first panel and a second panel. The first panel is offset from the second panel. The method further includes a step of forming a bracket having a body having a channel in communication with a gap extending from first and second ends of the body of the bracket and a flange extending from the body of the bracket such that a plane extending from the first and second ends of the body and positioned through a center of the gap may be positioned at an obtuse angle relative to the flange. The method also includes a step of coupling a first anchor with the first panel of the housing. Another step included in the method is positioning a first end of a condenser within the channel of the body of the bracket. The method further includes a step of coupling the bracket with the first anchor such that the condenser extends diagonally from the body of the bracket to the second panel of the housing.

These and other features, advantages, and objects of the present device will be further understood and appreciated by those skilled in the art upon studying the following specification, claims, and appended drawings.

DETAILED DESCRIPTION OF EMBODIMENTS

Figure 1:
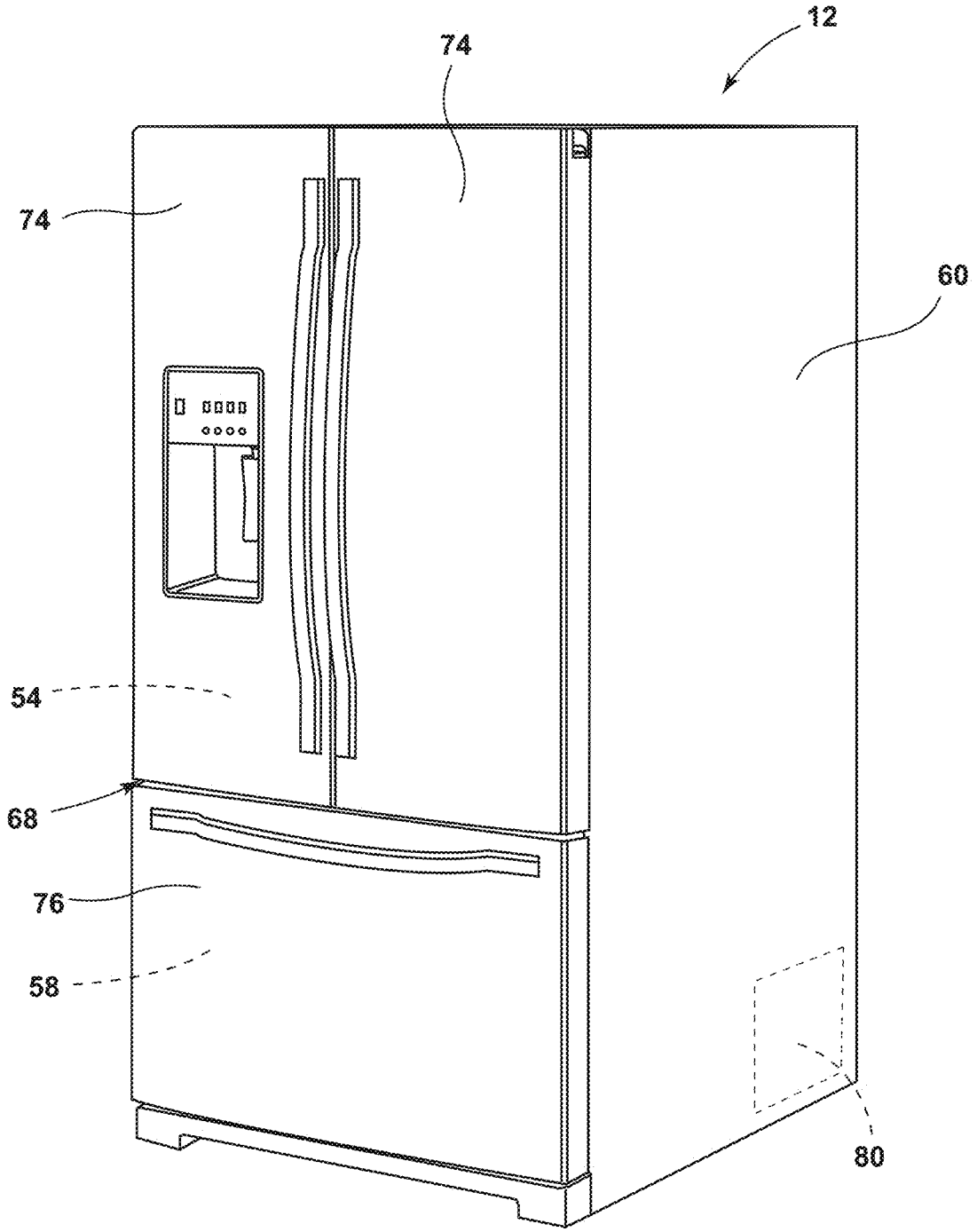
FIG. 1 is a side perspective view of a refrigerating appliance.

In this document, relational terms, such as first and second, top and bottom, and the like, are used solely to distinguish one entity or action from another entity or action, without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises . . . a" does not, without more constraints, preclude the existence of additional identical elements in the process, method, article, or apparatus that comprises the element.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

With reference to FIGS. 1-6, a condenser assembly 10 for a refrigerating appliance 12 is provided herein. The condenser assembly 10 includes a first anchor 14 coupled with a first panel 16 of a housing 18. A bracket 20 is coupled to the first anchor 14 and extends from the first panel 16 of the housing 18. The bracket 20 includes a body 22 having first and second ends 24, 26. A flange 28 extends from the body 22 and is coupled to the first anchor 14. A condenser 30 has first and second ends 32, 34. One of the first and second ends 32, 34 is operably coupled to the bracket 20 such that the condenser 30 is positioned at an obtuse angle A relative to the flange 28 of the bracket 20.

Referring to FIG. 1, a refrigerating appliance 12 is shown having a refrigerated compartment 54 configured to refrigerate consumables and a freezer compartment 58 configured to freeze consumables during normal use. Accordingly, the refrigerated compartment 54 may be kept at a temperature above the freezing point of water and generally below a temperature from about 35° F. to about 50° F., more typically below about 38° F. and the freezer compartment 58 may be kept at a temperature below the freezing point of water. In some instances, the refrigerating appliance 12 may have a cabinet 60 including the refrigerated compartment 54 and the freezer compartment 58. A mullion 68 may separate the refrigerated compartment 54 and the freezer compartment 58. FIG. 1 generally shows a refrigerator of the French-door bottom mount type, but it is understood that this disclosure could apply to any type of refrigerator, such as a side-by-side, two-door bottom mount, or a top-mount type refrigeration unit.

The refrigerating appliance 12 may have one or more doors 74, 76 that provide selective access to the interior volume of the refrigerating appliance 12 where consumables may be stored. As shown, the refrigerated compartment doors 74 selectively close the refrigerated compartment 54, and the freezer door 76 selectively closes the freezer compartment 58. It is appreciated that the refrigerated compartment 54 may have only one door 74.

Figure 2:
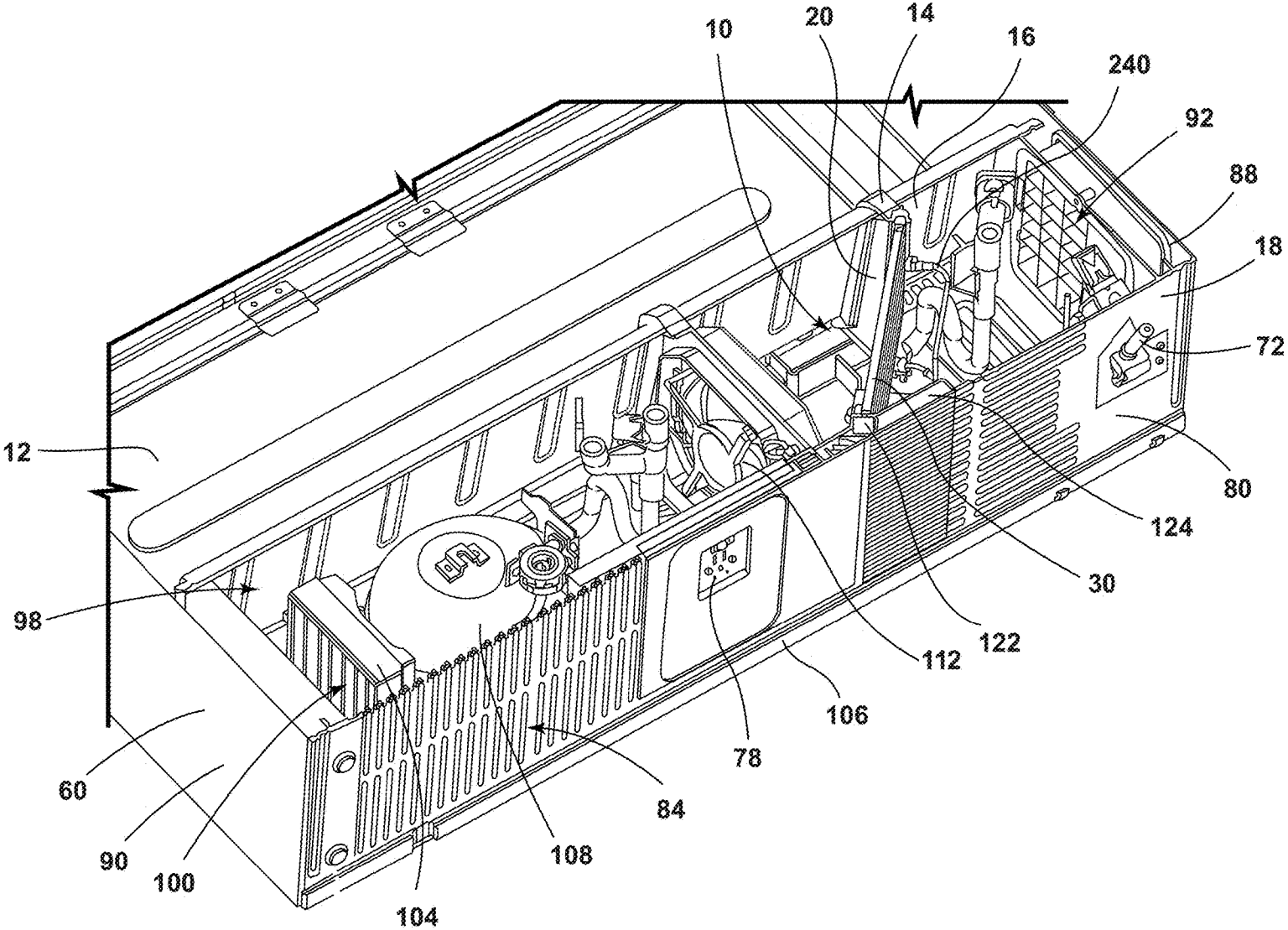
FIG. 2 is a top perspective view of a cooling unit positioned in a mechanical cavity of the refrigerating appliance of FIG. 1.

Referring to FIGS. 1 and 2, the cabinet 60 may include a rear panel 80 including a plurality of air apertures 84. The rear panel 80 may extend between a first sidewall 88 of the cabinet 60 and a second sidewall 90 of the cabinet 60. The first sidewall 88 of the cabinet 60 may include a vent 92 according to various examples. The first panel, or interior panel, 16 may also extend between the first and second sidewalls 88, 90 of the cabinet 60. According to various examples, the rear panel 80, the interior panel 16, the first and second sidewalls 88, 90, and a bottom panel 106 may form the housing 18. The interior panel 16 may be spaced away from the rear panel 80 to define a mechanical cavity 98. The mechanical cavity 98 may be defined at the lower rear of the cabinet 60, according to various examples. However, it is contemplated that the mechanical cavity 98 may be located in any position within the cabinet 60 of the appliance 12 without departing from the scope of the present disclosure.

The rear panel 80 may further include a water valve 72 and an electrical connection 78 configured to provide water and power to a cooling unit 100. The cooling unit 100 may be positioned within the mechanical cavity 98 and supported by the bottom panel 106 of the refrigerating appliance 12. The cooling unit 100 may be configured to maintain the temperature of at least one of the refrigerated compartment 54 and the freezer compartment 58 of the appliance 12. The cooling unit 100 may include at least an evaporator 104, a compressor 108, a fan 112, and the condenser 30 of the condenser assembly 10. These and any other components of the cooling unit 100 may be arranged and interconnected in a standard configuration for such components.

The first anchor 14 may be coupled to the interior panel 16 of the cabinet 60. Similarly, a second anchor 122 may be coupled to a mount 124 proximate the rear panel 80 of the cabinet 60. The first and second anchors 14, 122 may be positioned between the fan 112 and the first sidewall 88 of the cabinet 60. The first anchor 14 may be configured to be selectively coupled with the bracket 20. The bracket 20 and the second anchor 122 may each be configured to be selectively coupled with the condenser 30. The first anchor 14 may be positioned offset from the second anchor 122 such that the condenser 30 extends diagonally between bracket 20 and the second anchor 122 at an angle, as discussed elsewhere herein.

Figure 3:
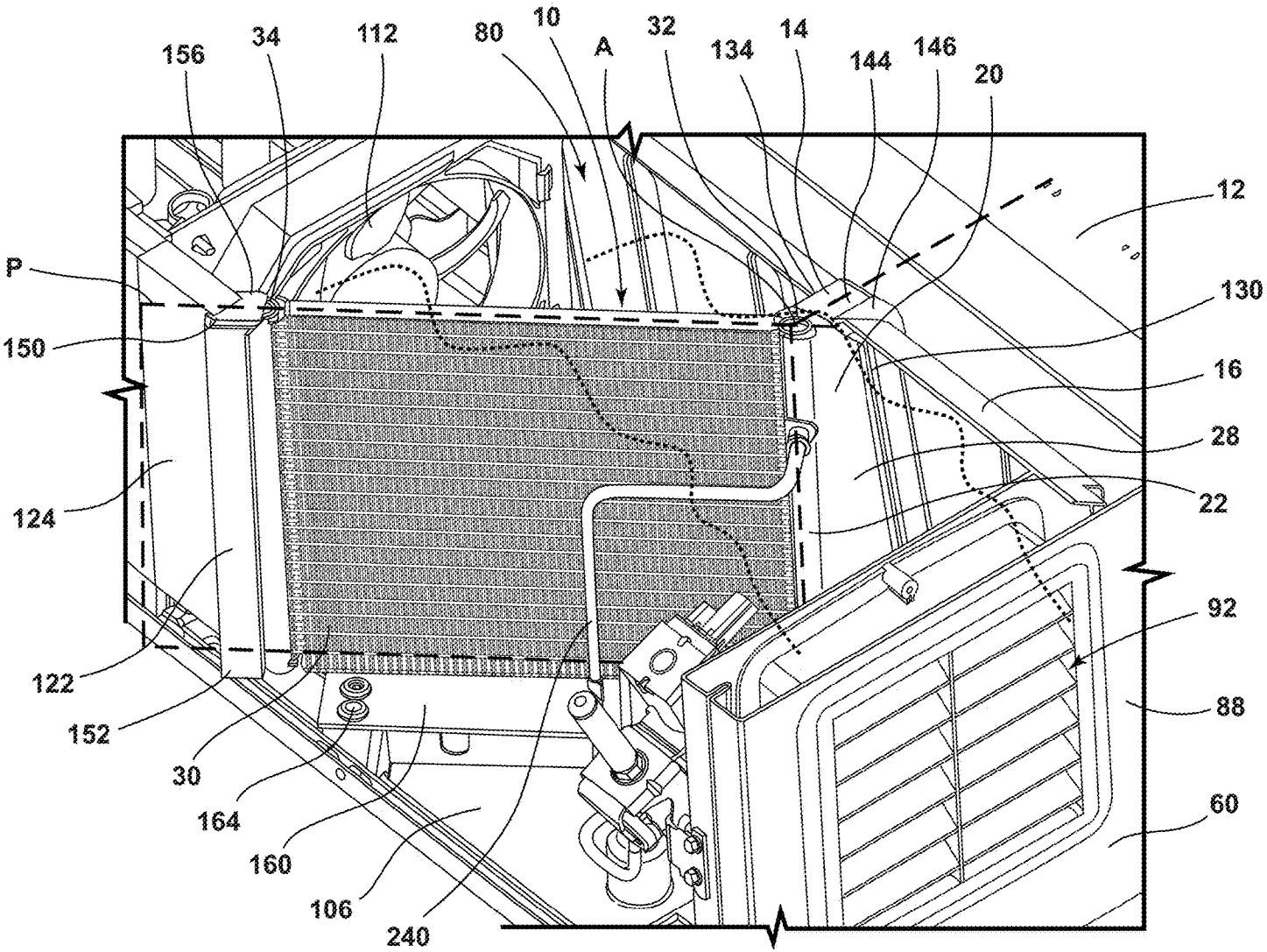
FIG. 3 is a side perspective of the cooling unit and mechanical cavity of FIG. 2 with a rear panel of the refrigerating appliance removed.
Figure 4:
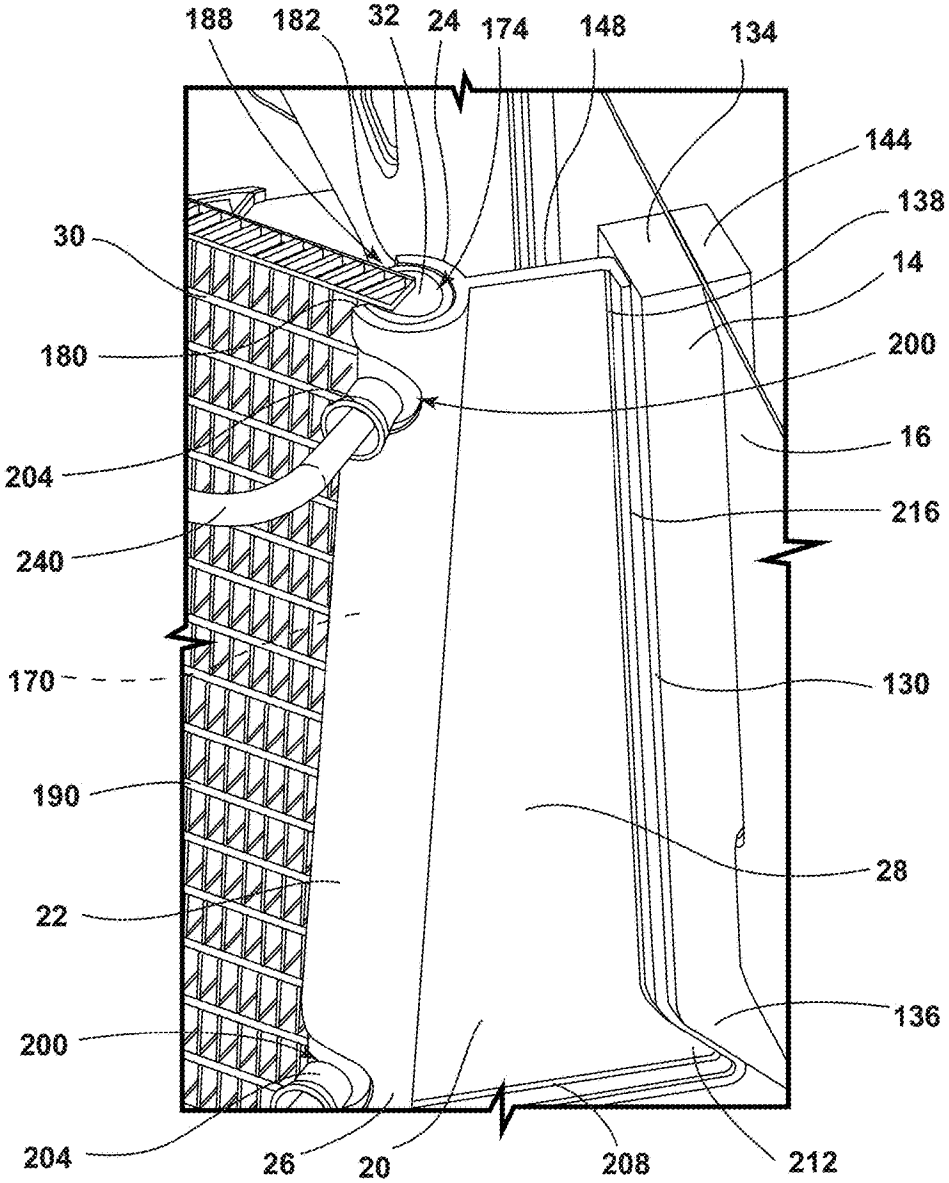
FIG. 4 is an enlarged view of an anchor coupled with a condenser within the mechanical cavity of FIG. 3.

Referring now to FIGS. 3 and 4, the first anchor 14 may be coupled with the interior panel 16 of the cabinet 60. According to various examples, the interior panel 16 may extend through a portion the first anchor 14. In other examples, the first anchor 14 may be integrally formed with the interior panel 16. In still other examples, the first anchor 14 may abut the interior panel 16 without intersection of the interior panel 16 and the first anchor 14. In still other examples, the first anchor 14 may be coupled with the interior panel 16 such that the first anchor 14 extends through the interior panel 16.

The first anchor 14 includes an outer surface 130 extending from a first end 134 of the first anchor 14 to a second end 136 of the first anchor 14. The outer surface 130 is shaped to complement an outer edge 138 of the flange 28 of the bracket 20. According to various examples, the outer surface 130 may be at least partially inclined upward and away from the second end 136 of the first anchor 14. In other examples, the outer surface 130 may extend substantially linearly from the first end 134 of the first anchor 14 to the second end 136 of the first anchor 14. In still other examples, the outer surface 130 may be arcuate, linear, or any combination thereof that provides a surface complementing and congruent to the outer edge 138 of the flange 28 of the bracket 20.

The first anchor 14 may further include an upper surface 144. The upper surface 144 may be positioned substantially perpendicularly to the interior panel 16. According to various examples, the first anchor 14 may include an upper lip 146. The upper surface 144 may extend the length of the upper lip 146 such that the upper surface 144 extends over an upper edge 148 of the flange 28 of the bracket 20. In other examples, the upper surface 144 may extend from the rear of the first anchor 14 to meet the outer surface 130 at the outer edge 138 of the flange of the bracket 20. The upper surface 144 of the first anchor 14 may be substantially perpendicular to the outer surface 130 of the first anchor 14.

Referring now to FIGS. 2 and 3, the second anchor 122 may be coupled to the rear panel 80 of the cabinet 60 of the refrigerating appliance 12. Alternatively, the second anchor 122 may be coupled to the mount 124 (FIG. 3). The second anchor 122 may have first and second ends 150, 152. According to various examples, the distance between the first and second ends 150, 152 of the second anchor 122 and the first and second ends 134, 136 of the first anchor 14 may be substantially equivalent. In other examples, the first and second anchors 14, 122 may be different sizes and may have different distances between the respective first ends 134, 150 and second ends 136, 152.

According to various examples, a lip 156 may extend from the first end 150 of the second anchor 122. The lip 156 may extend outward into the cavity 88. The lip 156 may be positioned over the second end 34 of the condenser 30 when the condenser 30 is positioned between the second anchor 122 and the bracket 20. The second end 34 of the condenser 30 may be coupled to the second anchor 122 to prevent inadvertent movement of the condenser 30. In other examples, the condenser 30 may include a foot 160 extending from a bottom of the condenser 30. The foot 160 may be coupled to the bottom panel 106 by a fastener 164. The fastener 164 may be configured as a single fastener 164 or may be a plurality of fasteners 164. The fastener 164 further may prevent inadvertent movement of the condenser 30. In other examples, the second anchor 122 and the fastener 164 may be used together to secure the condenser 30.

Figure 5:
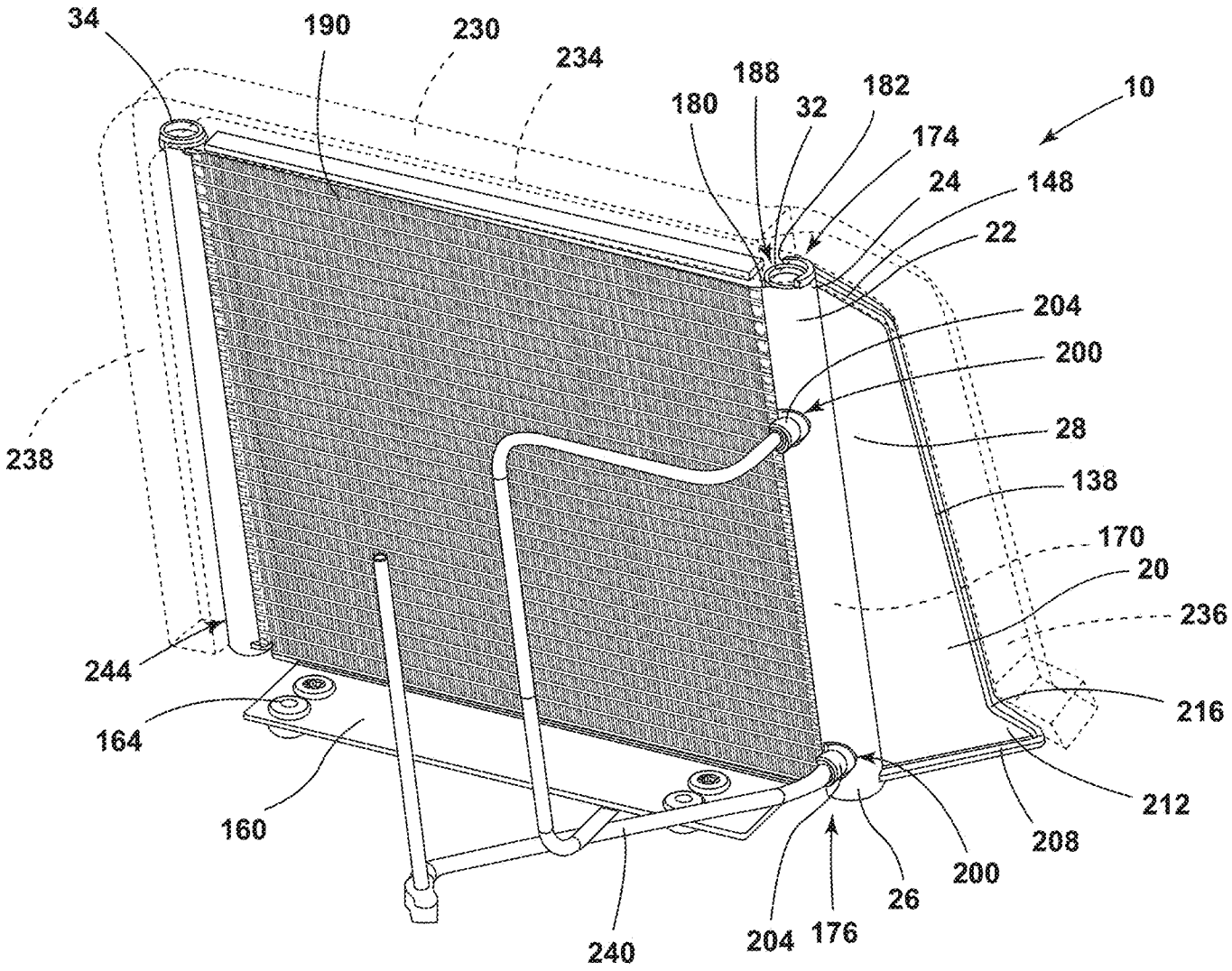
FIG. 5 is a first side perspective view of a condenser and an anchor according to various examples.
Figure 6:
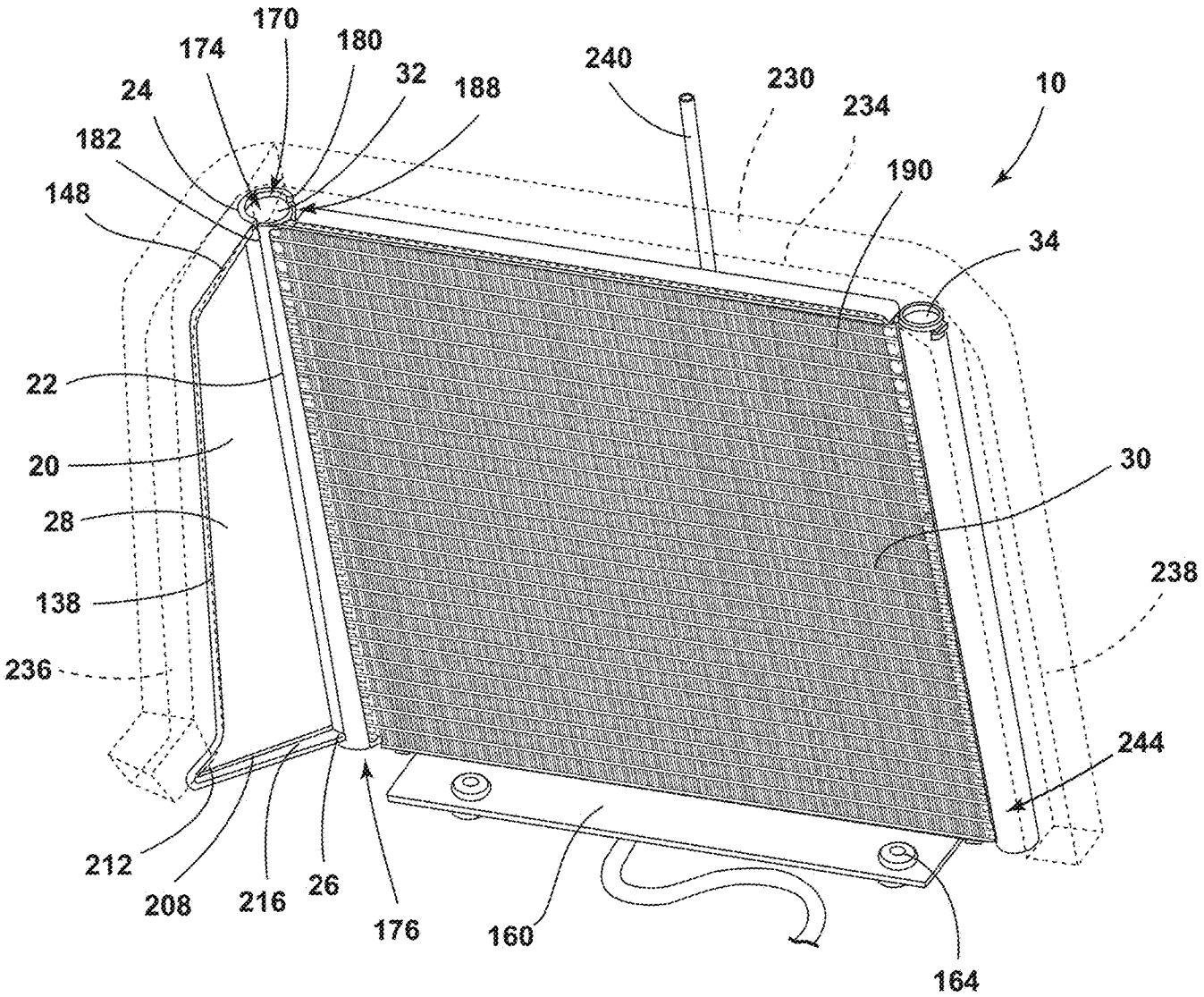
FIG. 6 is a second side perspective view of the condenser and anchor of FIG. 5.

Referring now to FIGS. 4-6, the bracket 20 includes the body 22 and the flange 28. The body 20 and the flange 28 may be formed of foam material. The body 22 of the bracket 20 includes the first end 24 and the second end 26. The body 22 may be generally cylindrical in shape. In other examples, the body 22 may be generally prismatic. In still other examples, the body 22 may have a cross-sectional shape configured to complement the shape of the first end 32 of the condenser 30.

The body 22 may define a channel 170 extending from the first end 24 of the body 22 to the second end 26 of the body 22. The channel 170 may have first and second open ends 174, 176 defined by the first and second ends 24, 26 of the body 22 of the bracket 20, respectively. According to various examples, the channel 170 may have a cross-sectional shape configured to complement and be congruent with the cross-sectional shape of the body 22 and the first end 32 of the condenser 30. In other examples, the channel 170 may have a cross-sectional shape that is congruent with the cross-sectional shape of the first end 32 of the condenser 30 while the cross-sectional shape of the body 22 differs from the first end 32 of the condenser 30 and the channel 170. The channel 170 may be configured to receive the first end 32 of the condenser 30 when the condenser 30 is coupled with the bracket 20.

The body 22 of the bracket 20 may form an outer wall of the channel 170 and may include a first edge 180 and a second edge 182. Each of the first and second edges 180, 182 of the body 22 of the bracket 20 may extend from the first end 24 of the body 22 to the second end 26 of the body 22. The first and second edges 180, 182 may be substantially parallel and may be spaced apart by a gap 188. The gap 188 may be in communication with the channel 170. According to various examples, the gap 188 may be sized to frame a central portion 190 of the condenser 30. In other examples, the gap 188 may be sized to be larger than the width of the central portion 190 of the condenser 30 such that the first end 32 of the condenser 30 may rotate when the first end 32 of the condenser 30 is positioned within the channel 170.

The body 22 may further define receiving wells 200 extending from one of the first edge 180 and the second edge 182 of the body 22 of the bracket 20. The receiving wells 200 may be in communication with the gap 188 and the channel 170. The receiving wells 200 are configured to align with connection ports 204 of the condenser 30. According to various examples, the connection ports 204 may be flush with the exterior surface of the first end 32 of the condenser 30. In other examples, the connection ports 204 may protrude outward from the exterior surface of the first end 32 of the condenser 30. The protrusion of the connection ports 204 may determine the width of the gap 188 and the distance between the first and second edges 180, 182 of the body 22 of the bracket 20. The connection ports 204 may be positioned such that the first end 32 of the condenser 30 may be received by the channel 170 and subsequently rotated to place the connection ports 204 within the receiving wells 200. In other examples, the body 22 of the bracket 20 may be configured to snap over the first end 32 of the condenser 30 when the connection ports 204 are aligned with the receiving wells 200. It will be understood that any number of receiving wells 200 and connection ports 204 may be used without departing from the scope of the present disclosure. It is also contemplated that the connection ports 204 may be positioned on the first end 32 and/or the second end 34 of the condenser 30.

The flange 28 of the bracket 20 includes the outer edge 138 and the upper edge 148. The upper edge 148 extends from the first end 24 of the body 22 to the outer edge 138. Similarly, a lower edge 208 extends from the second end 26 of the body 22 to the outer edge 138. The upper edge 148 may be oriented parallel to the lower edge 208. The upper edge 148 and the lower edge 208 may each be oriented perpendicular to the interior panel 16. Alternatively, the upper edge 148 may be positioned at an incline downward and away from the first end 24 of the body 22 of the bracket 20. In various examples, the outer edge 138 may extend linearly at an incline downward and away from the upper edge 148 to the lower edge 208. In other examples, the outer edge 138 may extend at an incline downward and away from the upper edge 148 and further along a foot 212 of the flange 28 to the lower edge 208. The foot 212 may be generally angular, arcuate, rectangular, or any other shape.

A lip 216 may extend from and may be perpendicular to the outer edge 138 and the lower edge 208. The lip 216 may extend from a first side of the flange 28, according to various examples. In other examples, the lip 216 may extend from both sides of the flange 28, forming a T-shape with the outer edge 138 and the lower edge 208. The lip 216 may be configured to align with and couple to the outer surface 130 of the first anchor 14. The lip 216 may also act as a foot to stabilize the bracket 20 along the outer edge 138 and the lower edge 208.

Referring now to FIGS. 3-6, the flange 28 of the bracket 20 extends from the body 22 of the bracket 20. The flange 28 is oriented such that the flange 28 forms an obtuse angle A (FIG. 3) with a plane P aligned with the condenser 30 and positioned through a center point of the central portion 190 of the condenser 30. The obtuse angle A may be any angle that positions the condenser 30 diagonally between the first and second anchors 14, 122 while also offsetting the condenser 30 from the first anchor 14.

Referring now to FIGS. 2-4, the condenser assembly 10 is configured to be installed within the mechanical cavity 98 such that the condenser 30 extends between the interior panel 16 and the rear panel 80 of the cabinet 60 of the refrigerating appliance 12. The first anchor 14 is operably coupled with the interior panel 16. The second anchor 122 may be operably coupled with the rear panel 80 of the cabinet 60 of the refrigerating appliance 12. Alternatively, the second anchor 122 may be coupled with a mount 124 extend from or positioned proximate to the rear panel 80 of the cabinet 60.

According to various examples, when the condenser 30 is coupled with the body 22 of the bracket 20, the first end 32 of the condenser 30 may be inserted into the channel 170 through the first open end 174. The first end 32 may slide through the channel 170 to the second open end 176 such that the first end 32 of the condenser 30 is fully received by the channel 170. In other examples, the condenser 30 may be rotated to move the connection ports 204 into the receiving wells 200 defined by the body 22 of the bracket 20. In still other examples, when the condenser 30 is coupled with the body 22 of the bracket 20, the body 22 may be configured to snap over the first end 32 of the condenser 30 via the gap 188. When the body 22 is configured to snap over the first end 32 of the condenser 30, the receiving wells 200 may be aligned to receive the connection ports 204 of the first end 32.

When the first end 32 of the condenser 30 is engaged with the body 22 of the bracket 20, the bracket 20 may be coupled with the first anchor 14 such that the flange 28 of the bracket 20 is positioned perpendicular to the interior panel 16. The condenser 30 may be positioned to extend diagonally toward the fan 112, away from the body 22 of the bracket 20, and toward the second anchor 122. The second end 34 of the condenser 30 may be coupled with the second anchor 122. Alternatively, the second end 34 of the condenser 30 may be positioned below the lip 156 of the second anchor 122 to secure the condenser 30 in place. When the condenser 30 is positioned diagonally between the first and second anchors 14, 122, the fasteners 164 may be used to secure the foot 160 of the condenser 30 to the bottom panel 106 of the cabinet 60 of the refrigerating appliance 12. Pipes or tubes 240 may then be connected with the connection ports 204 of the condenser 30 to couple the condenser 30 to the other components of the cooling unit 100.

As shown in FIGS. 5 and 6, the first and second anchors 14, 122 may be replaced by a single anchor 230. The anchor 230 may include a top portion 234, a first side portion 236 and a second side portion 238. The first side portion 236 may be shaped to complement and be congruent with the outer edge 138 of the flange 28 of the bracket 20. A surface of the first side portion 236 may be operably coupled with the bracket 20. The first side portion 236 may further extend at least partially over the first end 32 of the condenser 30.

The top portion 234 of the anchor 230 may be integrally formed with and extend between the first and second side portions 236, 238 of the anchor 230. The top portion 234 may be positioned to extend over the central portion 190 of the condenser 30, according to various examples. In other examples, the top portion 234 may extend at least partially over the first end 32 of the condenser 30 and over the central portion 190 of the condenser 30. In still other examples, the top portion 234 may extend at least partially over the first end 32 and the second end 34 of the condenser 30 and may extend over the central portion 190 of the condenser 30.

The second side portion 238 of the anchor 230 may be shaped to complement the second end 34 of the condenser 30. The second side portion 238 may extend downward from the top portion 234 of the anchor 230 such that a top of the second end 34 is positioned within a corner defined by the joinder of the top portion 234 and the second side portion 238 of the anchor. According to various examples, the second side portion 238 may be coupled with the second end 34 of the condenser 30. In other examples, the second side portion 238 may abut the second end 34 of the condenser 30 while the top portion 234 of the anchor 230 stabilizes the second end 34 of the condenser 30 to prevent inadvertent removal of the condenser 30.

Referring now to FIGS. 2, 5, and 6, when the single anchor 230 is used within the mechanical cavity 98, the installation process and use of the condenser assembly 10 may be similar to when first and second anchors 14, 122 are used. The first and second side portions 236, 238 of the anchor 230 may be positioned in place of the first and second anchors 14, 122, respectively. When the first end 32 of the condenser 30 is engaged with the body 22 of the bracket 20, the bracket 20 may be coupled with the first portion 236 of the anchor 230. The condenser 30 and the bracket 20 may be inserted into an opening 244 defined by the anchor 230. The opening 244 may be defined to complement the condenser 30 and the bracket 20 such that the condenser 30 and the bracket 20 are positioned flush with the anchor 230 when the condenser 30 and the bracket 20 are received within the opening 244. The foot 160 and the fasteners 164 may be used to couple the condenser 30 with the bottom panel 106 of the cabinet 60. The anchor 230 may be configured to prevent inadvertent movement of the condenser 30 and prevent damage to the condenser 30 and/or the bracket 20.

Referring now to FIGS. 1-6, a method 250 for positioning the condenser 30 within the refrigerating appliance 12 may include a step 254 of forming the housing 18 having the first and second sidewalls 88, 90 joined by the first panel, or the interior panel 16, and a second panel, or the rear panel 80 of the cabinet 60 of the refrigerating appliance 12. The first panel 16 may be offset from the second panel 80 to define the mechanical cavity 98 containing the cooling unit 100.

The method 250 may further include a step 258 of forming the bracket 20 having the body 22. The body 22 may define the channel 170. The channel 170 may be in communication with the gap 188 extending from the first and second ends 24, 26 of the body 22 of the bracket 20. The flange 28 may extend from the body 22 of the bracket 20 such that the plane P extending from the first and second ends 24, 26 of the body 22 and positioned through a center of the gap 188 may be positioned at the obtuse angle A relative to the flange 28. The obtuse angle A may be any angle that positions the condenser 30 diagonally between the first and second anchors 14, 122 while also offsetting the condenser 30 from the first anchor 14.

The method 250 may also include a step 262 of coupling the first anchor 14, 230 with the first panel 16 of the housing 18. In some examples, the anchor 230 may be positioned to extend diagonally between the first panel 16 and the second panel 80.

Another step 266 that may be included in method 250 is positioning the first end 32 of the condenser 30 within the channel 170 of the body 22 of the bracket 20. The first end 32 may be inserted into the channel 170 through the first or second open ends 174, 176. In some examples, the first end 32 may extend partially from one or both of the first and second ends 174, 176.

The method 250 may further include a step 270 of coupling the bracket 20 with the first anchor 14, 230 such that the condenser 30 extends diagonally from the body 22 of the bracket 20 to the second panel 80 of the housing 18. The second end 34 of the condenser 30 may be coupled with the second anchor 122. Alternatively, the second end 34 of the condenser 30 may be coupled to the anchor 230 such that the central portion 190 of the condenser 30 extends along the anchor 230.

The method 250 may further include a step 274 of forming the receiving well 200 defined by the body 22 of the bracket 20. The receiving well 200 may be in communication with the gap 188 and the channel 170. The receiving well 200 may include a plurality of receiving wells 200. Each receiving well 200 may be configured to receive the respective connection port 204 when the first end 32 of the condenser 30 is received within the channel 170 and the central portion 190 of the condenser 30 extend through the gap 188 of the body 22 of the bracket 20. The method 250 may also include a step 278 of positioning the condenser 30 within the channel 170 such that the connection port 204 may be in communication with the receiving well 200.

Another step 282 may be included in the method 250. The step 282 may include coupling the second anchor 122 to the second panel 80 of the housing 18. When the second anchor 122 is used, the first anchor 14 is used and coupled with the first panel 16 as opposed to the single anchor 230. The step 282 may also include coupling the second end 34 of the condenser 30 with the second anchor 122. The condenser 30 may be positioned to extend between the first anchor 14 and the second anchor 122.

A variety of advantages may be derived from the use of the present disclosure. For example, use of the bracket provided herein may decrease the air loss from the fan through the condenser. The bracket acts as a rigid wall between the condenser and the anchor and inner panel. This may prevent the air bypass between the inlet and the outlet. The alignment of the bracket and the anchors may also provide fewer connection gaps for the air to seep through. This may increase the efficiency of the cooling unit and the condenser by between about 5% and about 10%. The diagonal orientation of the condenser may further provide a larger surface area for the air to flow over, ensuring that the air moves through the condenser.

According to one aspect, a condenser assembly may be provided that may include a housing positioned within a refrigerating appliance. The housing may include a first panel spaced apart from a second panel. A first anchor may be operably coupled with the first panel. A second anchor may be operably coupled with the second panel. The first anchor may be offset from the second anchor. A bracket may be coupled with the second anchor. The bracket may define a channel extending from a first open end and a second open end. A flange may extend from the bracket. A condenser may have first and second ends and may extend diagonally between the first anchor and the bracket. One of the first and second ends may be received by the channel of the bracket.

According to another aspect, the bracket may further define a gap extending between first and second ends of the bracket. The gap may be defined in communication with the channel.

According to other aspects, a plane may extend along the condenser. The plane may extend through a centerline of the gap extending from the first and second ends of the bracket.

According to yet another aspect the flange may extend from the bracket at an obtuse angle relative to the plane.

According to still other aspects, a receiving space may be defined by the bracket in communication with the channel. The receiving space may be configured to receive a connection port of the condenser.

According to another aspect, the flange may include a lip extending perpendicular to a periphery of the flange.

According to yet another aspect, the lip may be operably coupled to an outer surface of the second anchor.

According to other aspects, the flange may further include a lip extending from an outer edge of the flange.

According to still other aspects, the second anchor may be shaped to complement the outer edge of the flange.

According to another aspect, a condenser assembly for a refrigerating appliance may be provided that may include an anchor coupled with a first panel of a housing. A bracket may be coupled to the anchor and may extend from the first panel of the housing. The bracket may include a body having first and second ends. A flange may extend from the body and may be coupled to the anchor. A condenser may have first and second ends. One of the first and second ends may be operably coupled to the bracket such that the condenser is positioned at an obtuse angle relative to the flange of the bracket.

According to yet another aspect, the anchor may extend between the first panel and a second panel of the housing.

According to other aspects, the anchor may extend along a top edge of the bracket and the condenser.

According to still other aspects, the flange may include a lip extending perpendicular to an outer edge of the flange.

According to yet another aspect, the body of the bracket may be generally prismatic. The body may define a channel and a gap. The gap may be in communication with the channel.

According to other aspects, the channel may extend from the first end of the body to the second end of the body.

According to another aspect, the body of the bracket may include a first edge extending from the first end of the body to the second end of the body and a second edge. The second edge may be positioned parallel to the first edge and may be spaced apart from the first edge by the gap.

According to yet another aspect, one of the first and second ends of the condenser may be received by the channel. A central portion of the condenser may extend through the gap.

According to still other aspects, a method for positioning a condenser within a refrigerating appliance may be provided. The method may include a step of providing a housing having first and second panels. The method may further include a step of providing a bracket including a body having a channel in communication with a gap and a flange extending from the body of the bracket such that the flange is oriented at an obtuse angle relative to a plane positioned through a center of the gap. The method may also include a step of coupling a first anchor with the first panel of the housing. Another step that may be included in the method is positioning a first end of a condenser within the channel of the body of the bracket. The method may further include a step of coupling the bracket with the first anchor such that the condenser extends diagonally from the body of the bracket to the second panel of the housing.

According to another aspect, the method may further include a step of forming a receiving well defined by the body of the bracket and in communication with the gap and the channel. The method may also include a step of positioning the condenser within the channel such that a connection port may be in communication with the receiving well.

According to still other aspects, the method may further include a step of coupling a second anchor to the second panel of the housing. The method may also include a step of coupling a second end of the condenser with the second anchor.

It will be understood by one having ordinary skill in the art that construction of the described disclosure and other components is not limited to any specific material. Other exemplary examples of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional central members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary examples is illustrative only. Although only a few examples of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connectors or other elements of the system may be varied, the nature or number of adjustment positions provided between the elements may be varied. It should be noted that the elements and/or assemblies of the system might be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary examples without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A condenser assembly comprising:

a housing positioned within a refrigerating appliance, the housing including a first panel spaced apart from a second panel;

a first anchor operably coupled with the first panel;

a second anchor operably coupled with the second panel, wherein the first anchor is offset from the second anchor;

a bracket coupled with the second anchor, the bracket defining a channel extending from a first open end and a second open end, wherein a flange extends from the bracket; and a condenser having first and second ends and extending diagonally between the first anchor and the bracket, wherein one of the first and second ends is received by the channel of the bracket.

2. The condenser assembly of claim 1, wherein the bracket further defines a gap extending between first and second ends of the bracket, and further wherein the gap is defined in communication with the channel.

3. The condenser assembly of claim 2, wherein a plane extends along the condenser, and further wherein the plane extends through a centerline of the gap extending from the first and second ends of the bracket.

4. The condenser assembly of claim 3, wherein the flange extends from the bracket at an obtuse angle relative to the plane, the angle configured to direct air flow through the condenser.

5. The condenser assembly of claim 1, wherein a receiving space is defined by the bracket in communication with the channel, the receiving space configured to receive a connection port of the condenser.

6. The condenser assembly of claim 1, wherein the flange includes a lip extending perpendicular to a periphery of the flange.

7. The condenser assembly of claim 6, wherein the lip is operably coupled to an outer surface of the second anchor.

8. The condenser assembly of claim 1, wherein the flange further defines a lip extending from an outer edge of the flange.

9. The condenser assembly of claim 8, wherein the second anchor is shaped to complement the outer edge of the flange.

10. A condenser assembly for a refrigerating appliance, comprising:

an anchor coupled with a first panel of a housing;

a bracket coupled to the anchor and extending from the first panel of the housing, the bracket comprising:

a body having first and second ends;

a flange extending from the body and coupled to the anchor; and a condenser having first and second ends, wherein one of the first and second ends is operably coupled to the bracket such that the condenser is positioned at an obtuse angle relative to the flange of the bracket.

11. The condenser assembly of claim 10, wherein the anchor extends between the first panel and a second panel of the housing.

12. The condenser assembly of claim 11, wherein the anchor extends along a top edge of the bracket and the condenser.

13. The condenser assembly of claim 10, wherein the flange includes a lip extending perpendicular to an outer edge of the flange.

14. The condenser assembly of claim 10, wherein the body of the bracket is generally prismatic, and further wherein the body defines a channel and a gap, the gap in communication with the channel.

15. The condenser assembly of claim 14, wherein the channel extends from the first end of the body to the second end of the body.

16. The condenser assembly of claim 14, wherein the body of the bracket includes a first edge extending from the first end of the body to the second end of the body and a second edge, the second edge positioned parallel to the first edge and spaced apart from the first edge by the gap.

17. The condenser assembly of claim 14, wherein one of the first and second ends of the condenser is received by the channel, and further wherein a central portion of the condenser extends through the gap.

18. A method for positioning a condenser within a refrigerating appliance, the method comprising steps of:

providing a housing having first and second panels;

providing a bracket including a body having a channel in communication with a gap and a flange extending from the body of the bracket such that the flange is oriented at an obtuse angle relative to a plane positioned through a center of the gap;

coupling a first anchor with the first panel of the housing;

positioning a first end of a condenser within the channel of the body of the bracket; and coupling the bracket with the first anchor such that the condenser extends diagonally from the body of the bracket to the second panel of the housing.

19. The method of claim 18, further comprising a step of:

positioning the condenser within the channel such that a connection port is in communication with a receiving well of the bracket.

20. The method of claim 18, further comprising steps of:

coupling a second anchor to the second panel of the housing; and coupling a second end of the condenser with the second anchor.

* * * * *